US008567598B2

(12) United States Patent
Gibson

(10) Patent No.: US 8,567,598 B2
(45) Date of Patent: Oct. 29, 2013

(54) PACKET

(75) Inventor: Paul Gibson, London (GB)

(73) Assignee: British American Tobacco (Investments) Limited, London (GB)

( * ) Notice: Subject to any disclaimer, the term of this patent is extended or adjusted under 35 U.S.C. 154(b) by 0 days.

(21) Appl. No.: 13/132,649

(22) PCT Filed: Nov. 17, 2009

(86) PCT No.: PCT/EP2009/065312
§ 371 (c)(1),
(2), (4) Date: Sep. 23, 2011

(87) PCT Pub. No.: WO2010/063569
PCT Pub. Date: Jun. 10, 2010

(65) Prior Publication Data

US 2012/0000801 A1 Jan. 5, 2012

(30) Foreign Application Priority Data

Dec. 4, 2008 (GB) ..... 0822143.4

(51) Int. Cl.
*B65D 85/10* (2006.01)

(52) U.S. Cl.
USPC ..... 206/268; 206/242; 220/833

(58) Field of Classification Search
USPC ..... 206/268, 242, 261, 263, 266, 265, 273, 206/271, 1.5; 220/315, 324, 833, 834, 326, 220/835; 229/160.1
See application file for complete search history.

(56) References Cited

U.S. PATENT DOCUMENTS

| | | | | | |
|---|---|---|---|---|---|
| 1,450,674 | A * | 4/1923 | Marston | 220/8 |
| 3,102,675 | A * | 9/1963 | Schrom | 206/251 |
| 3,708,108 | A * | 1/1973 | Rosenburg, Jr. | 229/225 |
| 4,471,881 | A * | 9/1984 | Foster | 220/837 |
| 5,417,339 | A * | 5/1995 | Liu | 220/315 |
| 5,630,508 | A * | 5/1997 | Petit | 206/387.1 |
| 5,806,671 | A | 9/1998 | Focke et al. | |
| 5,819,925 | A * | 10/1998 | Brizzi et al. | 206/268 |
| 5,904,244 | A | 5/1999 | Focke | |
| 5,938,018 | A | 8/1999 | Keaveney et al. | |
| 6,105,856 | A * | 8/2000 | Kakiuchi | 229/148 |
| 6,334,532 | B1 * | 1/2002 | Tambo et al. | 206/268 |
| 6,398,017 | B1 * | 6/2002 | Cafiero | 206/6 |
| 6,719,131 | B1 * | 4/2004 | Focke et al. | 206/268 |
| 6,742,651 | B1 * | 6/2004 | Focke et al. | 206/268 |
| 2003/0029746 | A1 * | 2/2003 | Draghetti et al. | 206/268 |
| 2004/0031706 | A1 | 2/2004 | Stringfield | |

FOREIGN PATENT DOCUMENTS

| | | | |
|---|---|---|---|
| DE | 1058428 | B | 5/1959 |
| DE | 19938167 | A1 | 2/2001 |
| EP | 0226359 | A2 | 6/1987 |
| EP | 0801010 | A1 | 10/1997 |

(Continued)

OTHER PUBLICATIONS

International Search Report and Written Opinion corresponding to PCT/EP2009/065312 mailed Jan. 29, 2010.

(Continued)

*Primary Examiner* — Steven A. Reynolds
(74) *Attorney, Agent, or Firm* — N W Poulsen

(57) ABSTRACT

A container (1) for smoking articles may have a container portion (3), a lid (5) connected by a hinge to the container portion (3) and a ratchet mechanism (26, 37, 50, 60, 70, 80, 110, 120, 130, 140) to resist opening the lid (5).

11 Claims, 11 Drawing Sheets

(56) References Cited

FOREIGN PATENT DOCUMENTS

| | | | |
|---|---|---|---|
| EP | 0894737 | A1 | 2/1999 |
| JP | 10-029677 | | 2/1998 |
| JP | 2003-507268 | A | 2/2003 |
| JP | 2004-079085 | | 3/2004 |
| WO | WO03039998 | A1 | 5/2003 |
| WO | WO2004028926 | A2 | 4/2004 |

OTHER PUBLICATIONS

International Preliminary Report on Patentability corresponding to PCT/EP2009/065312 mailed Mar. 10, 2011.
Office Action dated Jul. 30, 2013, for Japanese Patent Application No. 2011-538932.

* cited by examiner

PACKET

CLAIM FOR PRIORITY

This application is a National Stage Entry entitled to and hereby claims priority under §§365 and 371 to corresponding PCT Application No. PCT/EP2009/065312, filed Nov. 17, 2009, which in turn claims priority to British Application Serial No. GB 0822143.4, filed Dec. 4, 2008. The entire contents of the aforementioned applications are herein expressly incorporated by reference.

FIELD OF INVENTION

The invention relates to packaging for smoking articles, such as cigarettes. In particular the invention relates to packaging smoking articles in a packet comprising a hinge-lid.

BACKGROUND TO THE INVENTION

Cigarette packs with a lid that is attached by a hinge to one panel of the packet are known. It is a recognised problem for such cigarette packs that they have a tendency not to stay properly closed after the initial opening of the pack. This problem is sometimes referred to as "yawning" or "smiling". Furthermore, if the pack is held upside down when closed, the lid may open under the weight of the cigarettes inside and hence the cigarettes may fall out of the packet.

The following patent applications provide examples of hinge-lid packets that include a mechanism to counter such yawning: PCT patent application WO 2004/028926, PCT patent application WO 03/039998, U.S. Pat. No. 5,938,018, European patent EP 0894737 and U.S. Pat. No. 5,904,244. Many such existing packs include one or more protruding tabs ("ears") on the inner frame of the pack. These protrusions engage with the inside wall of the lid (or with a slot on the inside wall) to increase resistance to opening the lid.

It is desirable to provide a hinge-lid pack with improved resistance to opening the lid in order to allow the pack to be closed more securely. It is further desirable to provide a pack which provides an indication to a consumer that the pack is properly closed. It is still further desirable to provide a pack which provides an indication to the consumer when the pack is being opened or closed.

SUMMARY OF THE INVENTION

In one embodiment of the invention, a container for smoking articles comprises a container portion, a lid connected by a hinge to the container portion, and a ratchet mechanism to resist opening of the lid.

The ratchet mechanism may be asymmetric in operation, in that opening of the container is harder than closing. The resistance of the container to opening can be made relatively high compared to existing anti-yawn mechanisms. Furthermore, the ratchet mechanism may comprise a plurality of fixed or holding positions to resist opening of the container. Accordingly, even if one position is overcome, the container will not open until the resistance of the remaining ratchet positions has also been overcome. This again allows the (overall) resistance of the container to opening to be made relatively high compared to existing anti-yawn mechanisms. Furthermore, the ratchet mechanism may be robust, in that even if one of the fixed positions is weakened or broken, the remaining positions will still be effective to resist opening of the container.

At least part of the ratchet mechanism may be located on a front panel of the lid opposite the hinge. This location for the ratchet mechanism is generally the furthest from the hinge, and so provides the greatest moment for resisting rotation of the lid (for a given force strength of the mechanism).

The ratchet mechanism may comprise at least one-potentially multiple-paired combinations of a tooth and a ladder of slots. The ladder(s) of slots may be formed on the inside of the lid front panel. Each tooth engages the corresponding ladder of slots. Each ladder of slots defines a series of successive fixed holding positions for the ratchet mechanism to resist opening of the lid. The teeth of the ratchet mechanism may be cut to have a cantilevered arrangement. This then provides resilience for the ratchet mechanism that allows the container to open if sufficient force is applied.

The container may include a second inner lid. At least one tooth may be formed on the second inner lid as an extension of a topmost panel of the second inner lid. Alternatively, the teeth of the ratchet mechanism may be formed on an inner frame of the container.

According to the invention, there is provided a container for smoking articles comprising a container portion, a lid connected by a hinge to the container portion and a ratchet mechanism to resist opening of the lid.

The ratchet mechanism may comprise a first cooperating portion and a second cooperating portion, the first cooperating portion being located on the lid for engaging with a second cooperating portion to resist opening of the lid.

One of the first cooperating portion or second cooperating portion may comprise a ladder of slots and the other of the first cooperating portion or second cooperating portion may comprise at least one tooth configured to engage the ladder of slots.

The at least one tooth may have a cantilevered arrangement.

The first cooperating portion or second cooperating portion may comprise at least one embossed portion and the other of the first cooperating portion or second cooperating portion may comprise a plurality of embossed portions, the first and second cooperating portions being configured to frictionally engage to resist opening of the lid.

The first cooperating portion may be located on an inside face of a front panel of the lid opposite the hinge.

The first cooperating portion may be located on an inside face of a side panel of the lid adjacent to the hinge.

The container may further comprise an inner lid and the second cooperating portion may be located on said inner lid for engaging with the first cooperating portion to resist opening of the lid.

The second cooperating portion may comprise at least one tooth formed as an extension of a topmost panel of the inner lid.

The second cooperating portion may be located on an inner frame of the container portion for engaging with the first cooperating portion to resist opening of the lid.

The container may comprise multiple pairs of the first and second cooperating portions.

The container may comprise a pack configured to contain smoking articles.

The container may comprise a carton configured to contain a plurality of packs for containing smoking articles.

The ratchet mechanism provides a resistance to opening the lid of the container and thus allows the container to be closed more securely. The ratchet mechanism may allow the lid to move by degrees either during opening or during closing of the container. An audible sound may be generated by the cooperating portions upon movement of the lid, thereby providing an indication to a consumer that the lid is being opened or closed. Alternatively or additionally, perceptible vibrations may be generated by the cooperating portions upon movement of the lid, thereby providing an indication to a consumer that the lid is being opened or closed.

BRIEF DESCRIPTION OF THE DRAWINGS

Embodiments of the invention will now be described, by way of example only, with reference to the accompanying drawings in which.

DETAILED DESCRIPTION

Figure 1:
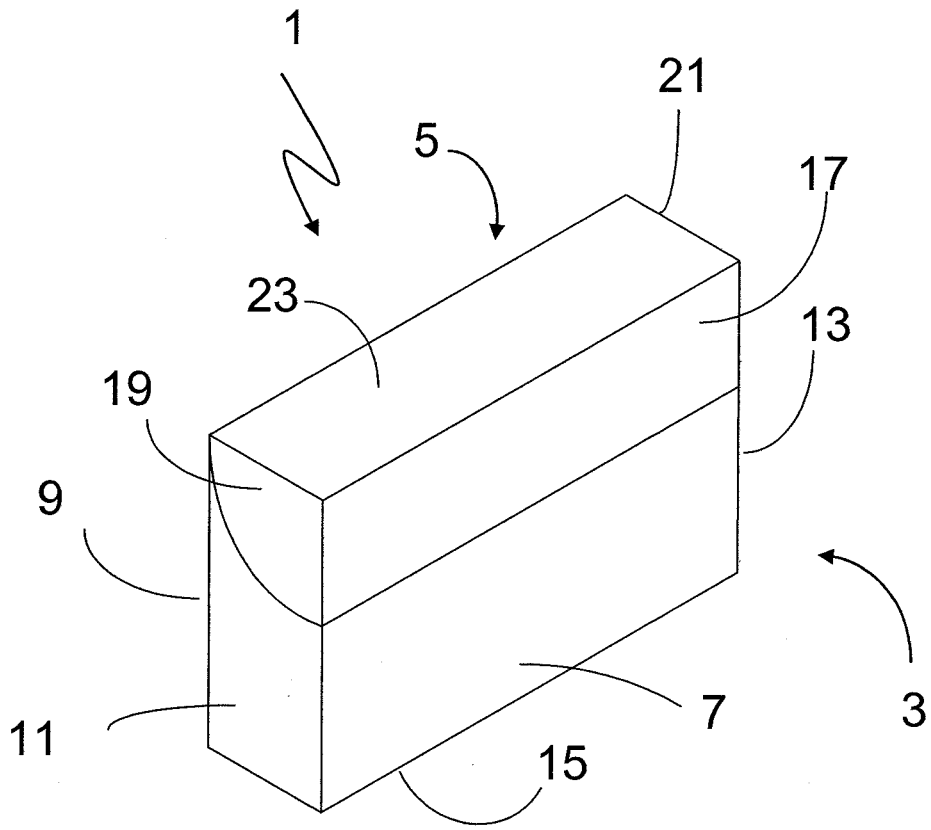
FIG. 1 shows a perspective view of a pack according to an embodiment of the invention when closed.

FIG. 1 shows a perspective view of a container in accordance with an embodiment of the invention. In the following examples, the container is described in the context of pack 1 for containing smoking articles such as cigarettes. However, the container could alternatively comprise a carton configured to contain a plurality of packs 1. The pack 1 includes a container portion 3 and an outer lid 5. The outer lid 5 is hinged to the container portion 3 in order to allow the pack 1 to be opened and closed. In FIG. 1 the pack 1 is shown fully closed.

According to the orientation shown in FIG. 1, the container portion 3 includes front and back panels 7, 9, two opposing side panels 11, 13, and a closed end 15, which forms the bottom of the pack 1. The top of the pack 1 is opposite the closed end 15 and is covered by the outer lid 5 when the outer lid 5 is closed. The outer lid 5 is attached to the container portion 3 by a hinge along the top edge of the back panel 9. The outer lid 5 includes a front panel 17, two opposing side panels 19, 21 and a top panel 23. When the outer lid 5 is closed, the front panel 17 of the outer lid 5 aligns with and abuts the front panel 7 of the container portion 3, while the opposing side panels 19, 21 of the lid 5 align with and abut the two opposing side panels 11 and 13 respectively of the container portion 3. The top panel 23 of the outer lid 5 is opposite the closed bottom end 15 of the container portion 3 and is attached by the hinge to the top of the back panel 9 of the pack 1.

Figure 2:
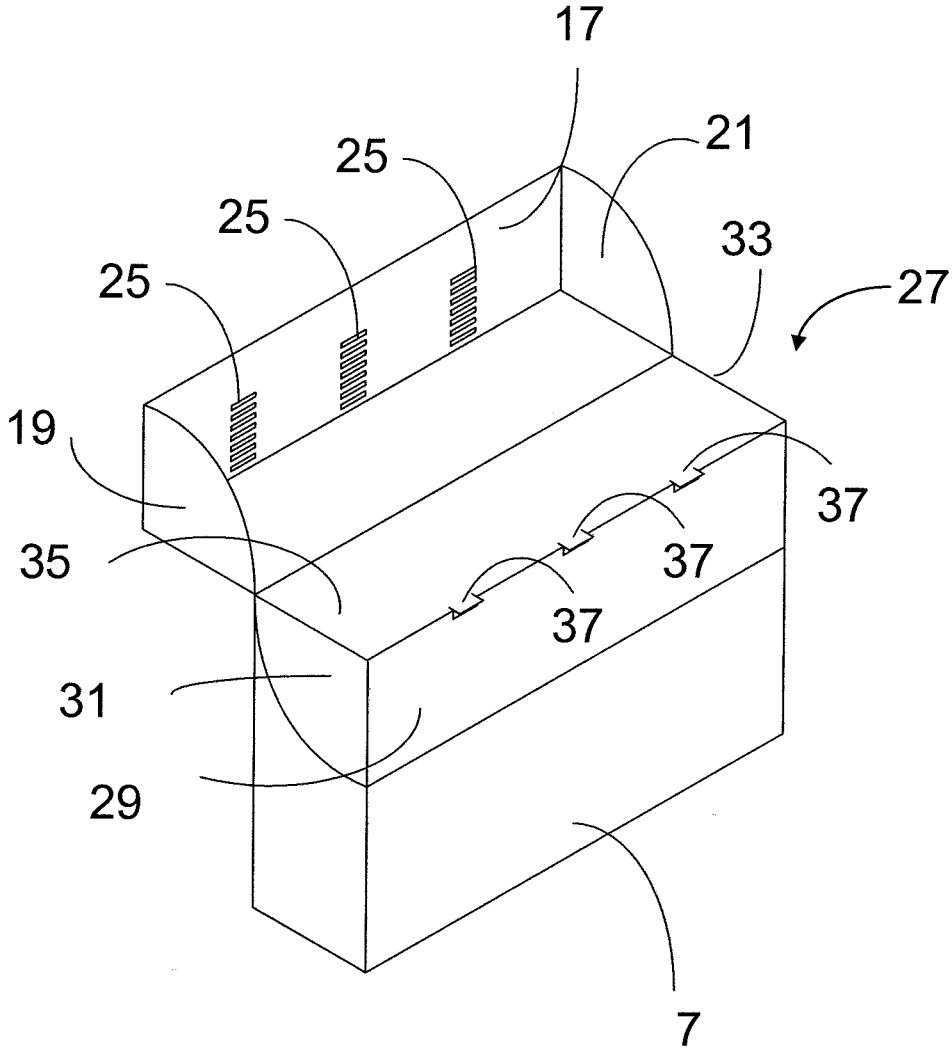
FIG. 2 shows a perspective view of the pack shown in FIG. 1 when the outer lid is open.

FIG. 2 shows a perspective view of the pack 1 with the outer lid 5 open. In the illustrated embodiment, the pack 1 also includes an inner lid 27. The inner lid 27 includes a front panel 29, two opposing side panels 31, 33 and a top panel 35. The inner lid 27 (in particular the front panel 29) is hinged to the container portion 3 along the top edge of the front panel 7. When the inner lid 27 is closed, as shown in FIG. 2, the front panel 29 of the inner lid 27 is substantially parallel to the front panel 7 of the container portion 3 so that it represents an extension of the front panel 7 of the container portion 3. Similarly, when the inner lid 27 is closed, the opposing side panels 31, 33 of the inner lid 27 are substantially parallel to the opposing sidewalls 11, 13 of the container portion 3 so that the side panels 31, 33 respectively provide extensions of the opposing side walls 11, 13 of the container portion 3. The top panel 35 of the inner lid 27 is opposite the closed bottom end 15 of the container portion 3. When the outer lid 5 is also closed, the front panel 17 of the outer lid 5 lies substantially parallel with and adjacent to the front panel 29 of the inner lid 27; the opposing side walls 19, 21 of the outer lid 5 lie substantially parallel with and adjacent to the respective opposing side panels 31, 33 of the inner lid 27; and the top panel 23 of the outer lid 5 lies substantially parallel with and adjacent to the top panel 35 of the inner lid 27. The outer lid 5 therefore fits snugly over the inner lid 27 when the pack 1 is closed.

Figure 3:
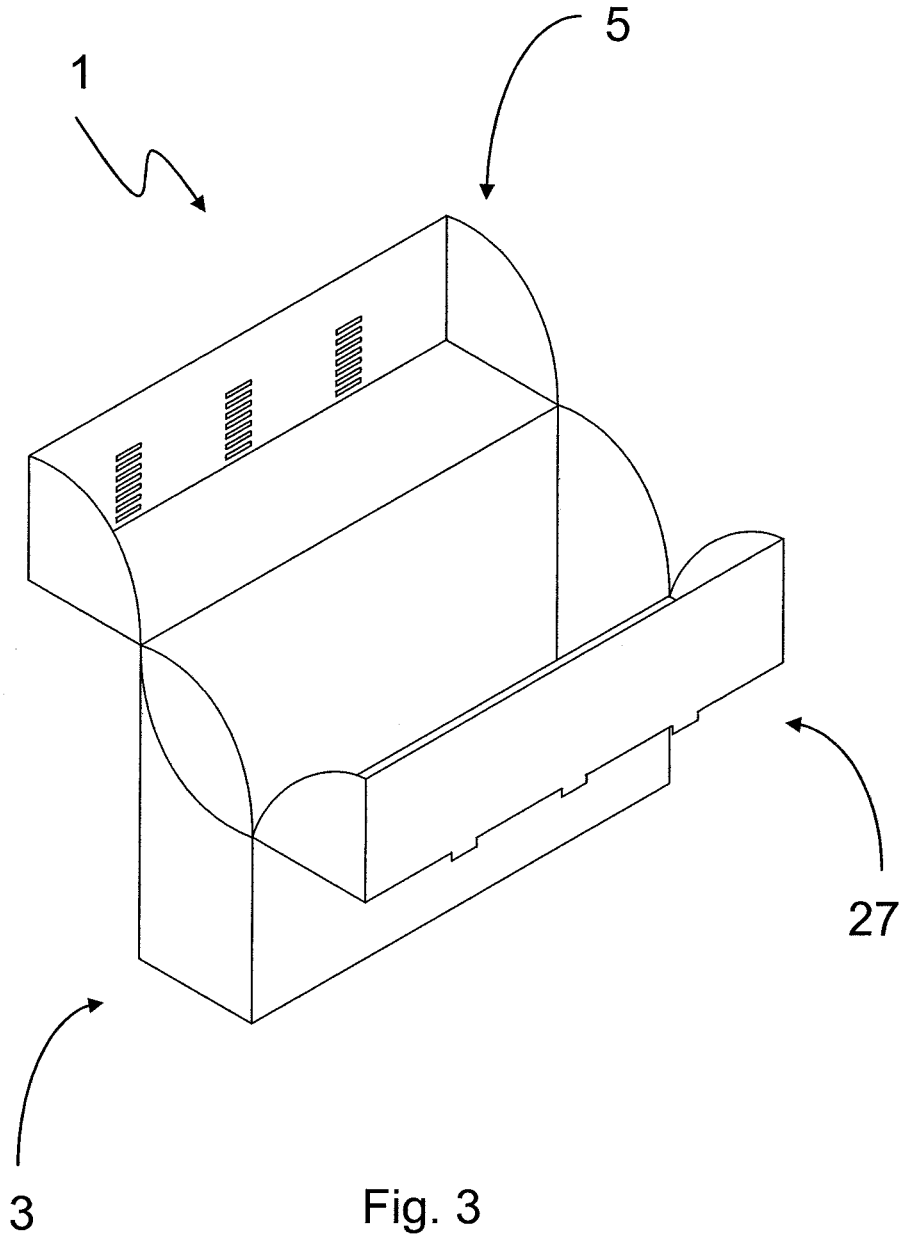
FIG. 3 shows a perspective view of the pack shown in FIG. 1 when both the inner lid and the outer lid are open.

FIG. 3 is a perspective view showing both the outer lid 5 open and the inner lid 27 open. This configuration allows access to the contents of the pack 1, e.g. smoking articles such as cigarettes. Although the hinge-lines of the outer lid 5 and the inner lid 27 are substantially parallel, the outer lid 5 and inner lid 27 are attached to the back and front of the container portion 3 respectively. In addition, the outer lid 5 and the inner lid 27 rotate in opposite directions when they are opened, as shown in FIG. 3. This arrangement for the outer lid 5 and the inner lid 27 helps to provide a secure and complete enclosure for the contents of the pack 1.

Once the outer lid 5 is open, as per the configuration of FIG. 2, the inner lid 27 can be rotated open to the configuration shown in FIG. 3 with little or no resistance. However, the pack 1 incorporates a ratchet mechanism, such that when the pack 1 is fully closed with both of the inner lid 27 and outer lid 5 in a closed position, there is much greater resistance to opening the pack 1. In particular, as explained in the examples described below, the ratchet mechanism includes a plurality of cooperating portions for providing resistance to opening the outer lid 5 from a closed position to an open position.

In one embodiment, the cooperating portions of the ratchet mechanism comprise at least one tooth 37 and a series of slots 26. The tooth 37 may engage with the series of slots 26 to provide resistance against opening the pack 1. For example, in the example shown in FIGS. 2 and 3, the pack 1 includes three ladder arrangements 25 located on the inside face of the front panel 17 of the outer lid 5. Each ladder arrangement 25 comprises a plurality of horizontal slots 26, each of which extends in a direction parallel to the bottom 15 of the pack 1. The slots 26 may be in a stacked configuration, such that they are formed one on top of another with intermediate bridge portions to form the ladder arrangement 25.

Figure 3A:
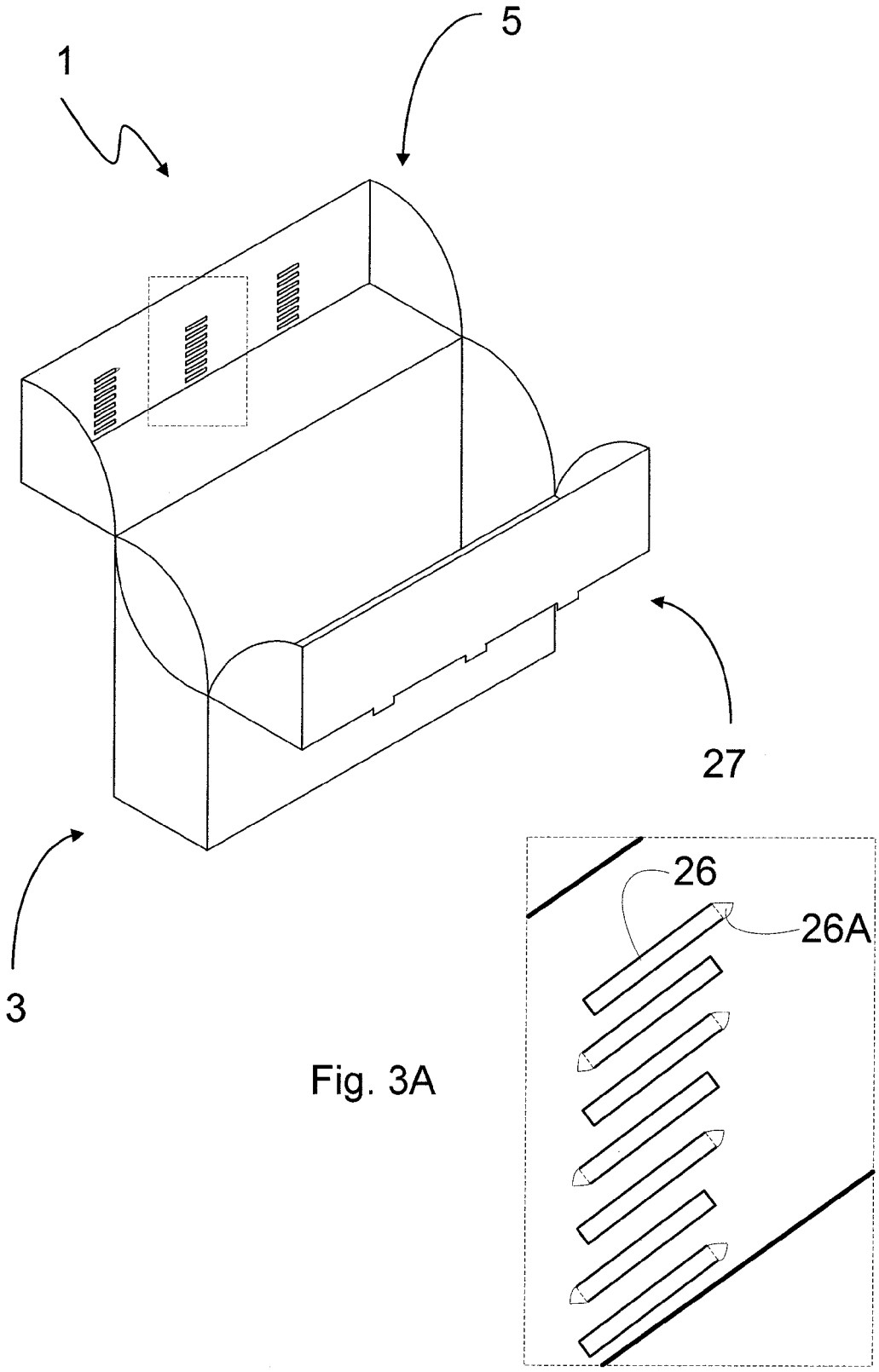
FIG. 3A shows an enlarged view of a ladder arrangement comprising a plurality of slots each having a slot annex.

Each slot 26 may comprise an annex portion 26A, as shown in the expanded portion of FIG. 3A. The annex portions 26A provide an entry point in the pack from which the slots 26 can be formed. In this example, the annex portions 26A provide an entry point through which a cutting tool is inserted to cut out the material which needs to be removed for forming the slots 26. The annex portions 26A are thus included for manufacturing purposes to ease the formation of the ladder arrangements 25.

In one embodiment, each ladder arrangement 25 comprises seven slots 26, but it will be appreciated that the number of slots 26 per ladder arrangement 25 may vary from one embodiment of the pack 1 to another. Furthermore, the number of slots 26 may vary from one ladder arrangement 25 to another in a single pack 1. For example, one ladder arrangement 25 may comprise seven slots 26 whilst an adjacent ladder arrangement 25 may have only five slots 26.

In the embodiment shown in FIG. 2 there are three ladders arrangements 25, but it will be appreciated that the number and/or spacing of the ladder arrangements 25 may vary from one embodiment to another. For example, in one embodiment the two outer ladder arrangements 25 might be omitted, while in another embodiment, the central ladder arrangement 25 might be omitted. In a further embodiment, there may be four, five or more ladder arrangements 25 which are, for example, spaced equally across the inside face of the front panel 17 of the outer lid 5.

In the example shown in FIGS. 2 and 3, the inner lid portion 27 includes one or more teeth 37 for cooperating with the ladder arrangements 25. In this example, the inner lid 27 includes three teeth 37 that extend out from the top panel 35 of the inner lid 5 such that the teeth 37 project outwards substantially perpendicularly to the front panel 29 of the inner lid 27. There may be a hole in the front panel 29 of the inner lid 27 immediately below each tooth 37, which is formed where the tooth 37 is cut out from the front panel 29. The sides of each tooth 37 may be cut back into the top panel 35 of the inner lid 27 in a cantilever arrangement. This provides the teeth 37 with some springiness or resilience for motion up and down.

Each tooth 37 is located in line with a corresponding ladder arrangement 25, so that when the inner lid 27 is closed, and as the outer lid 5 is being closed, each tooth 37 engages the corresponding ladder arrangement 25. In particular, on opening or closing the outer lid 5, each tooth 37 engages in succession two or more of the slots 26 of the corresponding ladder arrangement 25.

More specifically, as the outer lid 5 is closed, the teeth 37 are initially deflected downwards by the inside of the front panel 17. For each ladder arrangement 25, when the first slot 26 is reached, the teeth 37 return to a straight configuration (i.e. substantially parallel with the top panel 35 of the inner lid 27) by extending into the first (lowest) slot in the corresponding ladder arrangement 25. As the lid 5 is closed further, the teeth 37 disengage with the first slots 26 of the ladder arrangements 25 and the bridge portion between the first and second slots 26 of each ladder arrangement 25 deflects each tooth 37 downward again, until the second slot 26 is reached, at which point the teeth 37 extend into the second slot 26 and spring back again to the straight configuration. This procedure continues until the lid 5 is fully closed.

In some embodiments, the teeth 37 may not engage the full length of the corresponding ladder arrangement 25. For example, for the pack 1 shown in FIGS. 1 to 3, the teeth 37 may not contact the ladder arrangement 25 on the inside of the front panel 17 as the outer lid 5 is closed until after one or more of the bottom slots 26 of the ladder arrangements 25 have already passed the teeth 37. Similarly, the outer lid 5 may reach a fully closed position before the teeth 37 engage with the topmost slots in the ladder arrangements 25.

The interaction between the teeth 37 and the ladder arrangements 25 upon opening the outer lid 5 is generally the reverse of that on closing. In particular, on opening the outer lid 5, the teeth 37 are deflected upwards by the movement of the outer lid 5 until a slot 26 is reached, whereupon the teeth 37 return to the straight configuration substantially parallel to the top panel 35 of the inner lid 27. The teeth 37 are then deflected upwards again by the bridge portion between the current slot 26 and the next slot 26, until the next slot 26 is reached, whereupon the teeth 37 return to the horizontal orientation extending into the next slot 26. Eventually, the outer lid 5 is opened to the extent that the teeth 37 disengage completely from the ladder arrangements 25 on the inside of the front panel 17. Once this occurs, opening of the outer lid 5 can be continued without further resistance from the ratchet mechanism.

With the combination of teeth 37 and corresponding ladder arrangements 25 described above, it will be appreciated that closing the outer lid 5 onto the inner lid 27 is generally somewhat easier than (re)opening the outer lid 5 due to the front panel 17 of the outer lid 27 being substantially perpendicular to the teeth 37 when the outer lid 5 is closed. More particularly, when the outer lid 5 is closed, the teeth 37 are fully engaged with slots 26 in the corresponding ladder arrangements 25, thereby providing a high degree of resistance to opening the outer lid 5. This effect helps to overcome any tendency for the pack 1 to "yawn".

Figure 4:
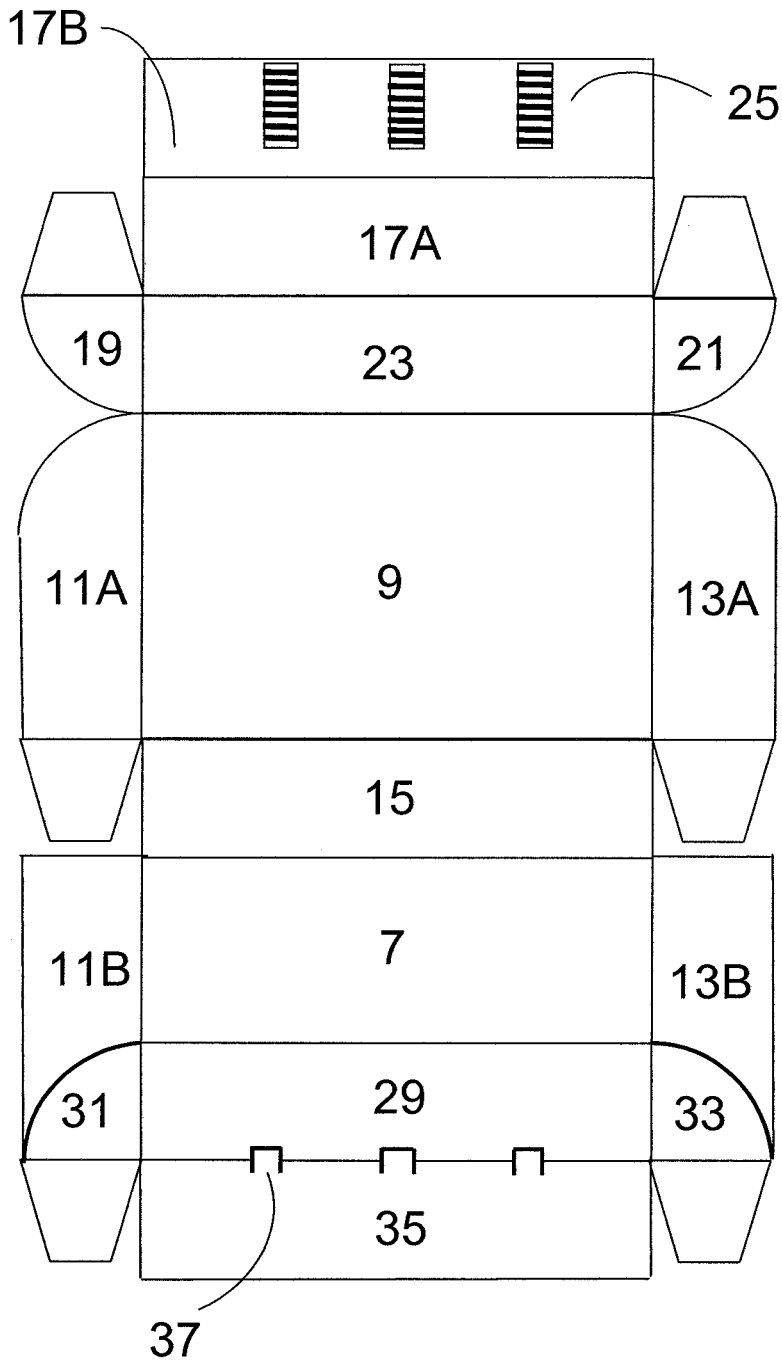
FIG. 4 illustrates a blank for forming the pack shown in FIGS. 1 to 3.

FIG. 4 illustrates a blank for forming a pack 1 as shown in FIGS. 1 to 3 in accordance with one embodiment of the invention. The panels of the blank in FIG. 4 are labelled to match the panels illustrated in FIGS. 1 to 3.

The inner lid 27 comprises panels 29, 35, 31 and 33. The hinge for the inner lid 27 with the container portion 3 is formed along the line between panel 29 and panel 7. Side panels 31 and 33 are cut to separate them from panels 11B and 13B respectively. The tabs attached to panels 31 and 33 are folded and adhered onto panel 35 in the assembled pack 1 to form the shape of the inner lid 27. The teeth 37 are cut out along the boundary of panels 29 and 35. The only internal cuts in the illustrated blank are for the teeth 37, to separate panels 31 and 33 from 11B and 13B respectively, and for forming the slots in the ladder arrangements 25.

The container portion 3 comprises panels 7, 15, 9, 11A, 11B, 13A and 13B. The tabs attached to panels 11A and 13A are folded and adhered onto panel 15 in the assembled pack 1 to form the bottom shape of the container portion 3. Panels 11B and 13B are then folded and adhered onto the outside of panels 11A and 13A respectively to form side walls 11 and 13 for the container portion 3.

The outer lid 5 comprises panels 23, 17A, 17B, 19 and 21. The hinge for the outer lid 5 with the container portion 3 is formed along the line between panel 23 and panel 9. The slots for the ladder arrangements 25 are cut into panel 17B. The tabs attached to panels 19 and 21 are folded and adhered onto panel 17A in the assembled pack 1 to form the shape of the outer lid 5. Panel 17B is then folded back and adhered onto panel 17A to form front panel 17. In the assembled pack 1, the tabs attached to panels 19 and 21 are therefore sandwiched between panels 17A and 17B.

In another embodiment, the ratchet mechanism may comprise teeth 37 formed in one or both of the side panels 31, 33 of the inner lid 27 and a corresponding ladder arrangement 25 of slots 26 formed in one or both of the side panels 19, 21 of the outer lid 5. The teeth 37 and ladder arrangements 25 engage with one another in the same manner as previously described.

As an alternative, or in addition, to the teeth 37 and ladder arrangements 25 described above, the cooperating portions of the ratchet mechanism may comprise a series of embossed portions for providing resistance against opening the pack 1 through frictional contact between them.

Figure 5:
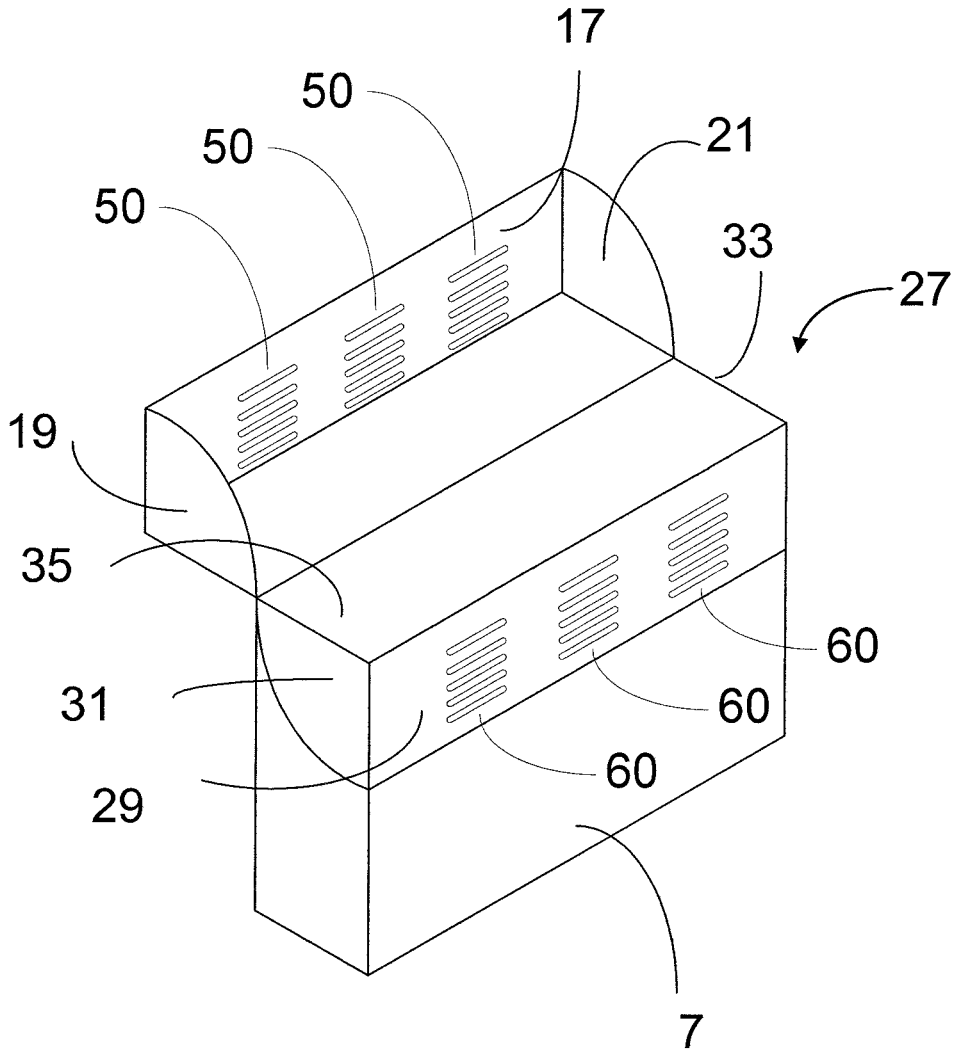
FIG. 5 is a perspective view of a pack comprising inner and outer hinged lids, wherein an outer surface of a front panel of the inner lid comprises a plurality of elongate embossed portions for frictionally engaging with a corresponding plurality of elongate embossed portions on an inner surface of a front panel of the outer lid when both lids are closed.

In one example, as shown in FIG. 5, a series of parallel, elongate embossed portions 50 are formed on the inside face of the front panel 17 of the outer lid 5 of a pack 2 similar to the pack 1 shown in FIGS. 2 and 3. A corresponding series of parallel, elongate embossed portions 60 are formed on the outside face of the front panel 29 of the inner lid 27. The embossed portions 50, 60 contact and engage with one another when the outer lid 5 is in a closed position to overcome any tendency of the outer lid 5 to "yawn".

Figure 6:
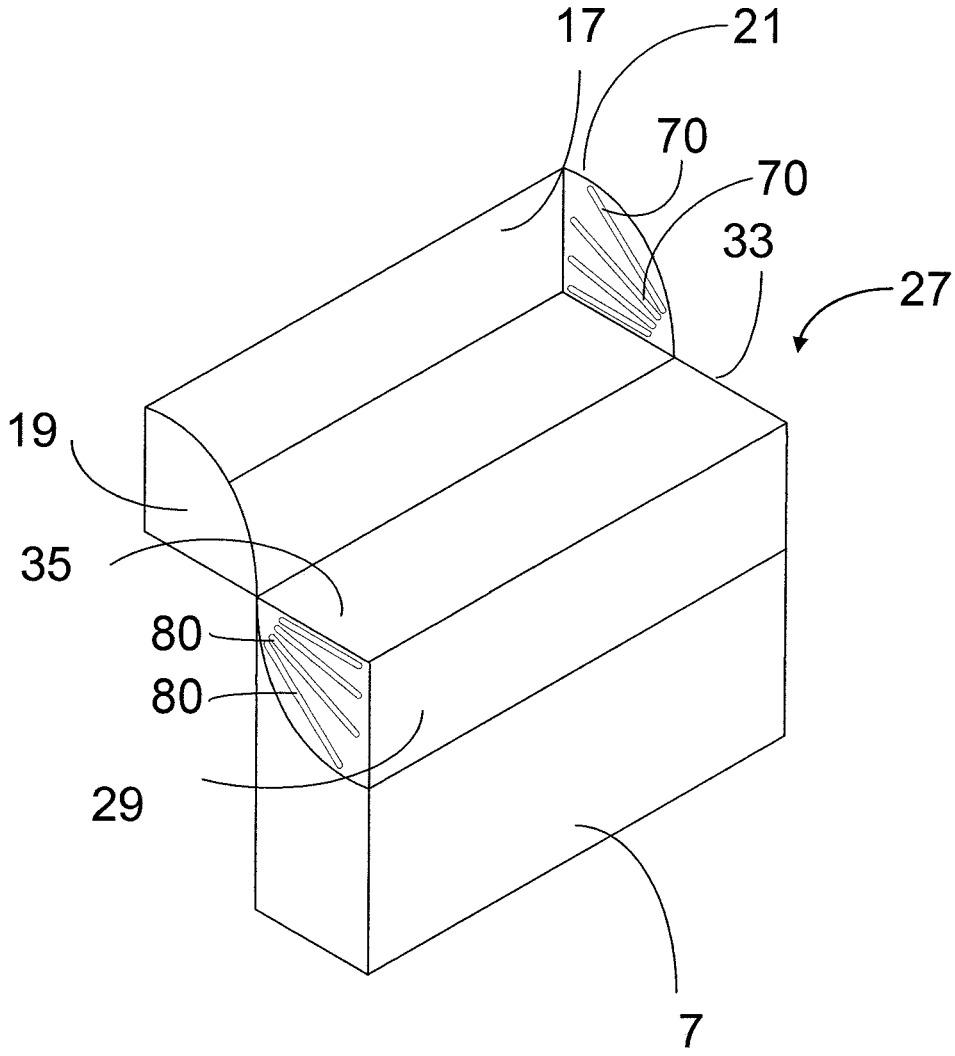
FIG. 6 is a perspective view of a pack comprising inner and outer hinged lids, wherein outer surfaces of opposing side panels of the inner lid comprise a plurality of embossed portions for frictionally engaging with corresponding embossed portions on inner surfaces of opposing side panels of a front panel of the outer lid when both lids are closed.

Referring to FIG. 6, in another example, a series of elongate embossed portions 70 are formed on the inner faces of the opposing side panels 19, 21 of the outer lid 5 in a fan-like configuration. A series of elongate embossed portions 80 are formed in a corresponding fan-like configuration on the outside faces of the opposing side panels 31, 33 of the inner lid 27. As with the example described in relation to FIG. 5, the embossed portions 70, 80 contact and engage with one another when the outer lid 5 is in a closed position to overcome any tendency of the outer lid 5 to "yawn". Although in FIG. 6, the embossed portions 70, 80 formed on the side panels 19, 21, 31, 33 of the outer and inner lids 5, 27 are the only ratchet mechanism provided, it will be appreciated these embossed portions 70, 80 could be used in combination with the embossed portions 50, 60 formed on the front panels 17, 29 of the outer and inner lids 5, 27 described above.

In addition, any or all of the embossed portions 50, 60, 70, 80 may be used in combination with the teeth 37 and ladder arrangements 25 previously described.

Figure 7:
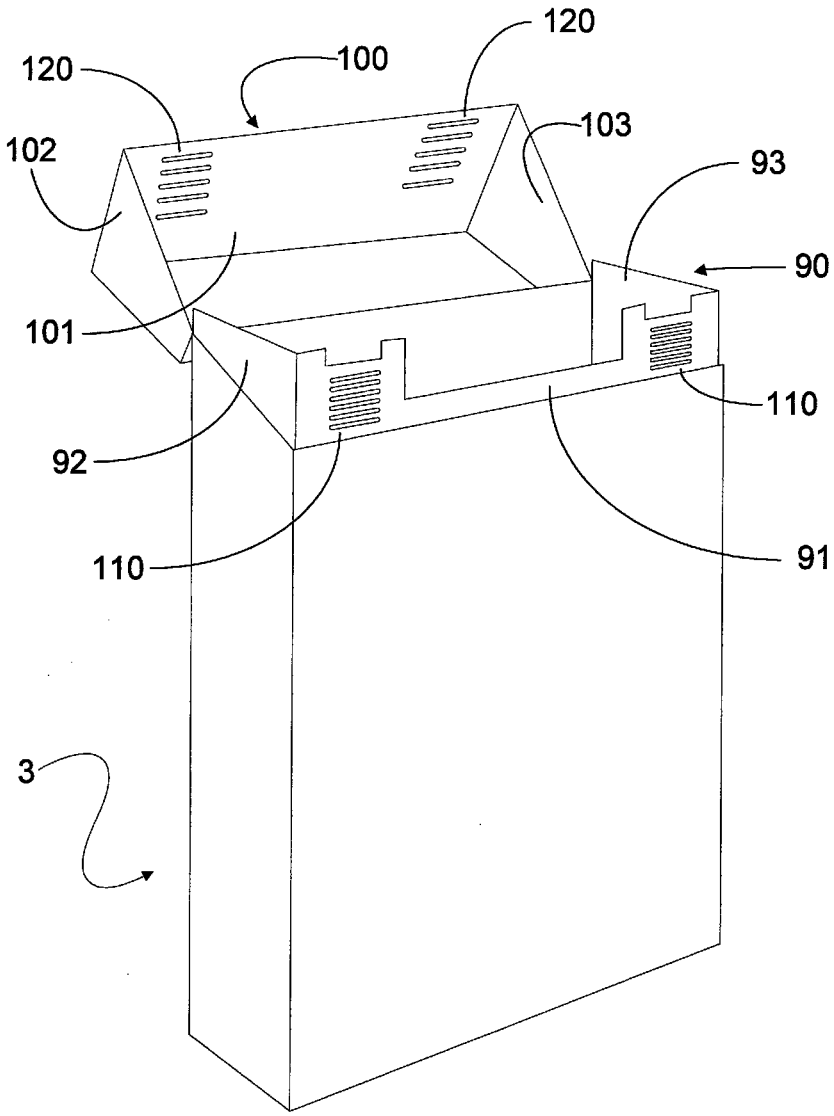
FIG. 7 is a perspective view of a pack comprising an inner frame and a hinged lid, wherein an outer surface of a front panel of the inner frame comprises a plurality of elongate embossed portions for frictionally engaging with a plurality of elongate embossed portions on an inner surface of a front panel of the outer lid when the outer lid is closed.

Embossed portions may equally be applied to prevent "yawning" in a conventional cigarette pack. For example, referring to FIG. 7, a conventional cigarette pack 3 comprises a hinged lid 100 and a container portion comprising an inner frame 90. The inner frame 90 comprises a front panel 91 and opposing side panels 92, 93, which are exposed when the lid 100 is open. As shown in FIG. 7, a plurality of parallel, elongate embossed portions 110 may be formed on the outer surface of the front panel 91 of the inner frame 90 to interact with corresponding elongate embossed portions 120 on the inner surface of a front panel 101 of the lid 100.

Figure 8:
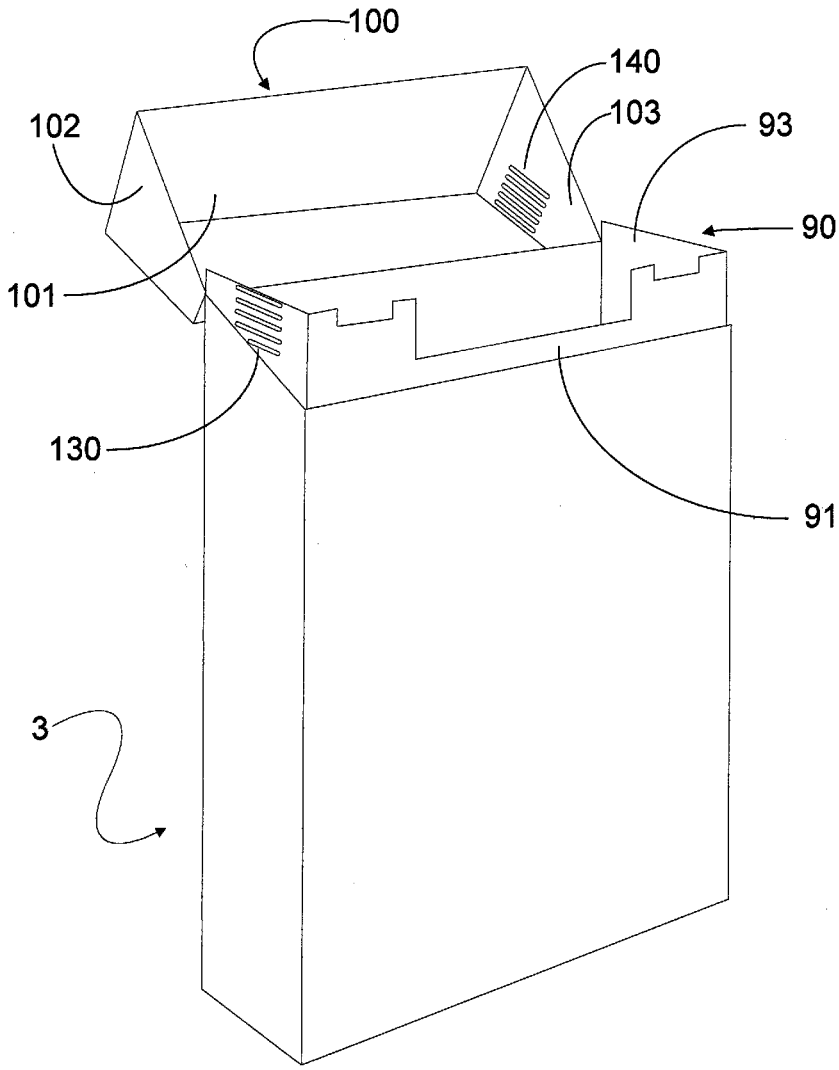
FIG. 8 is a perspective view of a pack comprising an inner frame and a hinged lid, wherein outer surfaces of opposing side panels of the inner frame comprise a plurality of elongate embossed portions for frictionally engaging with a plurality of elongate embossed portions on inner surfaces of opposing side panels of the outer lid when the outer lid is closed.
Figure 9:
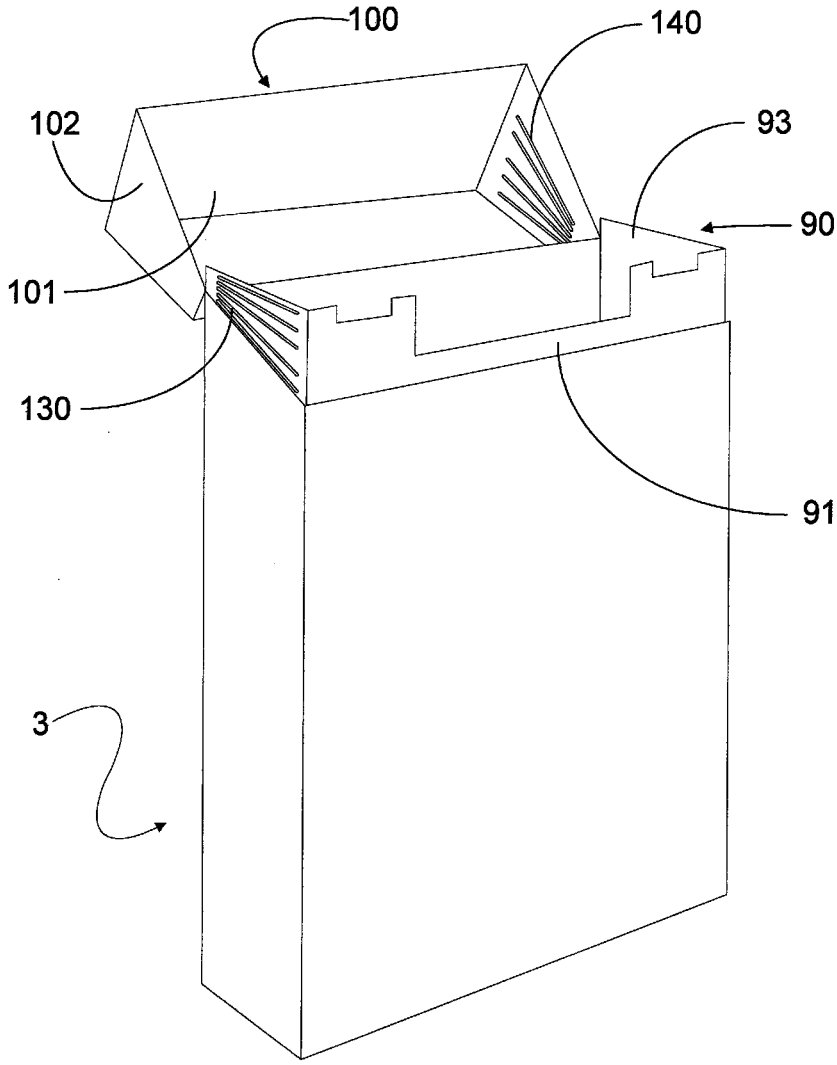
FIG. 9 is a perspective view of a pack comprising an inner frame and a hinged lid, wherein outer surfaces of opposing side panels of the inner frame comprise a plurality of elongate embossed portions in a fan like configuration for frictionally engaging with a plurality of elongate embossed portions in a corresponding fan like configuration on inner surfaces of opposing side panels of the outer lid when the outer lid.

Referring to FIG. 8, alternatively or in addition to the embossed portions 110, 120 on the front panel 91 of the inner frame 90 and front panel 101 of the lid 100, the conventional pack 3 may comprise embossed portions 130 formed on the outer surfaces of the opposing side panels 92, 93 of the inner frame 90. These embossed portions 130 may engage with corresponding embossed portions 140 on the inner surface of opposing side panels 102, 103 of the lid 100. FIG. 8 shows the embossed portions 130, 140 as being arranged parallel to one another. However, it will be appreciated that any configuration of the embossed portions suitable for providing resistance to the opening of the lid 100 could be used. For example, as shown in FIG. 9, the embossed portions 130, 140 may be provided in fan-like configurations on the outer surface of the opposing side panels 92, 93 of the inner frame 90 and the inner surface of opposing side panels 102, 103 of the lid 100.

Figure 10:
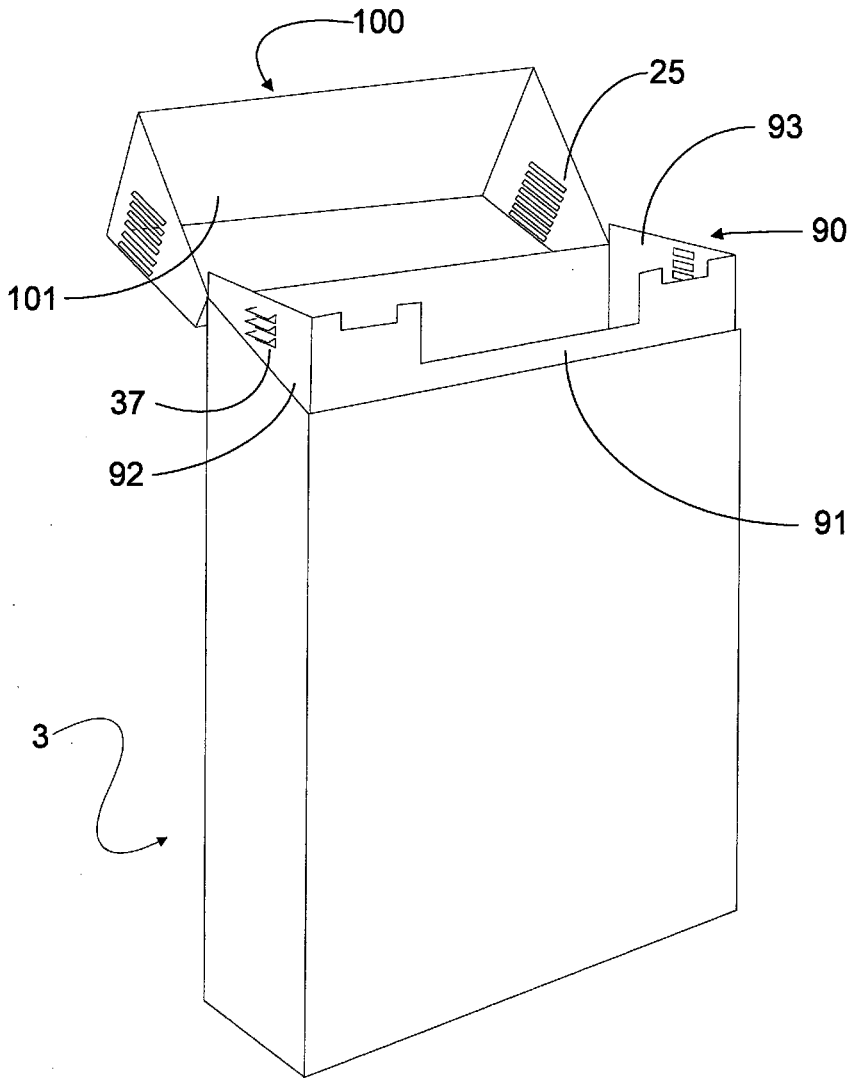
FIG. 10 is a perspective view of a pack comprising an inner frame and a hinged lid, wherein outer surfaces of opposing side panels of the inner frame comprise at least one tooth for engaging with ladder arrangements on opposing side panels of the outer lid when the outer lid is closed.

The conventional cigarette pack 3 may also include a ratchet mechanism comprising a tooth 37 and ladder arrangement 25 similar to that described above in relation to FIGS. 2 and 3. This could be included in addition, or as an alternative, to the embossed portions described above. In more detail, referring to FIG. 10, teeth 37 may be provided on the outer surfaces of the opposing side panels 92, 93 of the inner frame 90 to engage with corresponding ladder arrangements 25 formed on the inner faces of the opposing side panels 102, 103 of the lid 100. Teeth 37 may additionally or alternatively be provided on the outer face of the front panel 91 of the inner frame 90 to engage with corresponding ladder arrangements 25 on the inside face of the front panel 101 of the lid 100. It will be appreciated that the teeth 37 could alternatively be provided on the inside face of either the front panel 101 or side panels 102, 103 of the lid 100 for engaging with corresponding ladder arrangements 25 on the outer face of the front panel 91 or side panels 92, 93 of the inner frame 90.

The above described embodiments and examples may be used either singly or in combination to achieve the effects of the invention.

The skilled person will be aware of various modifications that may be made to the embodiments described above. For example, while the ratchet mechanism has been described in conjunction with a pack that opens along a hinge parallel to the longest axis of the pack, in other embodiments the pack may open along a different axis, e.g. as for a more conventional hinged-lid pack, where the hinge line is perpendicular to the longest axis of the pack. Furthermore, while the ratchet mechanism has been described in conjunction with a pack that has an opening inner lid and opening outer lid, in other embodiments there may be just a single opening lid. For example, the teeth of the ratchet mechanism might be provided on the inner frame of an otherwise conventional hinged-lid pack. The ratchet mechanism could also be used with packs with other shapes and dimensions to those described above and shown in the Figures. For example, the ratchet mechanism could be included on packs with rounded or bevelled edges to allow teeth to successively engage slots in a ladder arrangement. In conclusion, the scope of the present invention is defined by the appended claims and their equivalents.

The invention claimed is:

1. A smoking article package comprising:

a container portion containing a plurality of smoking articles;

a smoking article package lid connected by a hinge to the container portion; and a ratchet mechanism to resist opening of the lid, the ratchet mechanism providing more resistance to said opening of the lid than closing of the lid, wherein the ratchet mechanism comprises a plurality of holding positions for the smoking article package lid allowing the smoking article package lid to move by degrees during at least one of opening and closing of the container portion containing the plurality of smoking articles.

2. The package according to claim 1, wherein the ratchet mechanism comprises a first cooperating portion and a second cooperating portion, the first cooperating portion located on the smoking article package lid for engaging with the second cooperating portion to resist opening of the smoking article package lid.

3. The package according to claim 2, wherein one of the first cooperating portion and second cooperating portion comprises a ladder of slots and the other of the first cooperating portion and second cooperating portion comprises at least one tooth configured to engage the ladder of slots.

4. The package according to claim 3, wherein the at least one tooth has a cantilevered arrangement.

5. The package according to claim 2, wherein one of the first cooperating portion and second cooperating portion comprises at least one embossed portion and the other of the first cooperating portion and second cooperating portion comprises a plurality of embossed portions, the first cooperating portion and second cooperating portion being configured to frictionally engage to resist opening of the smoking article package lid.

6. The package according to claim 2, wherein the first cooperating portion is located on an inside face of a front panel of the smoking article package lid opposite the hinge.

7. The package according to claim 2, wherein the first cooperating portion is located on an inside face of a side panel of the smoking article package lid adjacent to the hinge.

8. The package according to claim 2 further comprising an inner smoking article package lid wherein the second cooperating portion is located on said inner smoking article package lid for engaging with the first cooperating portion to resist opening of the smoking article package lid.

9. The package according to claim 8, wherein the second cooperating portion comprises at least one tooth formed as an extension of a topmost panel of the inner smoking article package lid.

10. The package according to claim 2, wherein the second cooperating portion is located on an inner frame of the container portion for engaging with the first cooperating portion to resist opening of the smoking article package lid.

11. The package according to claim 2, wherein the package comprises multiple pairs of first cooperating portions and second cooperating portions.

* * * * *